US008327855B2

(12) United States Patent
Wetzel et al.

(10) Patent No.: US 8,327,855 B2
(45) Date of Patent: Dec. 11, 2012

(54) PROCESS FOR PREPARING A TOBACCO BLEND

(75) Inventors: Pierre Wetzel, Nant/Sugiez (CH); Frederic Buehler, Neuchatel (CH)

(73) Assignee: Philip Morris USA Inc., Richmond, VA (US)

( * ) Notice: Subject to any disclaimer, the term of this patent is extended or adjusted under 35 U.S.C. 154(b) by 721 days.

(21) Appl. No.: 12/421,833

(22) Filed: Apr. 10, 2009

(65) Prior Publication Data

US 2009/0260644 A1 Oct. 22, 2009

(30) Foreign Application Priority Data

Apr. 16, 2008 (EP) ..... 08154644

(51) Int. Cl.
*A24B 3/02* (2006.01)

(52) U.S. Cl. ..... 131/302; 131/299; 131/108

(58) Field of Classification Search ..... 131/300, 131/302, 304, 306, 309, 290, 108, 299
See application file for complete search history.

(56) References Cited

U.S. PATENT DOCUMENTS

| | | | | |
|---|---|---|---|---|
| 2,016,535 A | | 10/1935 | Bogaty | |
| 3,590,826 A | * | 7/1971 | Wochnowski et al. | 131/108 |
| 4,116,203 A | | 9/1978 | Wochnowski | |
| 4,408,619 A | * | 10/1983 | Perkins | 131/108 |
| 4,418,706 A | | 12/1983 | Kim et al. | |
| 6,158,441 A | | 12/2000 | Grigutsch et al. | |
| 2002/0033182 A1 | | 3/2002 | Ehling et al. | |

FOREIGN PATENT DOCUMENTS

| | | | |
|---|---|---|---|
| DE | 524 864 | | 5/1931 |
| DE | 622 452 | | 11/1935 |
| EP | 0 528 227 | A1 | 2/1993 |
| EP | 0 895 721 | A1 | 2/1999 |
| EP | 1 177 730 | A1 | 2/2002 |
| EP | 1 450 122 | A1 | 8/2004 |
| GB | 2 426 566 | A | 11/2006 |
| WO | WO 2007/048419 | A1 | 5/2007 |
| WO | WO 2007/134879 | A1 | 11/2007 |

OTHER PUBLICATIONS

European Search Report for Application No. 01854644.2-2313.
International Search Report and Written Opinion dated Jul. 6, 2009 for PCT/EP2009/054433.

* cited by examiner

*Primary Examiner* — Richard Crispino
*Assistant Examiner* — Dionne Walls Mayes
(74) *Attorney, Agent, or Firm* — Buchanan Ingersoll & Rooney PC

(57) ABSTRACT

In a process for preparing a tobacco blend, at least two different types of tobacco are thermally treated and blended so as to form the tobacco blend. Thermal treatment as well as blending of the different types of tobacco is performed by introducing the different types of tobacco into a combined thermal treating and blending unit, where thermally treating as well as blending of the at least two different types of tobacco is performed.

9 Claims, 2 Drawing Sheets

PROCESS FOR PREPARING A TOBACCO BLEND

CROSS-REFERENCE TO RELATED APPLICATIONS

This application corresponds to European Application EP 08154644, filed Apr. 16, 2008, the entire contents of which are incorporated herein by this reference thereto.

BACKGROUND OF THE DISCLOSURE

The present invention relates generally to a process for preparing a tobacco blend, and to apparatus for preparing a tobacco blend.

A plurality of different tobacco blends each containing at least two different types of tobacco are available on the market. The various tobacco blends have different recipes for blending the different tobacco types. Tobacco types can be, by way of example, Burley, Flue Cured, Oriental, Bright and Reconstituted tobacco. Burley, Flue Cured and Oriental tobacco are specific sorts of tobacco, while Bright tobacco is a pre-blend of Flue Cured and Oriental tobacco. These tobaccos may be used in pre-blended form and processed as pre-blend. The two components contained in this pre-blend are considered as behaving equally throughout the process, for example with regard to cutting, expansion and drying. Reconstituted tobacco denotes tobacco made from tobacco parts that were collected during previous handling of tobacco, for example during the cutting.

From WO 2007/134879 a flash dryer for tobacco is known comprising a drying channel having two or more inlets arranged at different levels along the drying channel. Tobaccos having different moisture contents can be fed into the process gas flowing through the drying channel so that the tobacco can be dried.

Usually, different tobacco types are treated individually with respect to moisture, temperature, impregnation, casing, cutting width, and so on, in accordance with their specific characteristics and needs. This individual treatment of the respective tobacco types also applies for the expansion and drying steps, in order to optimize the specific characteristics of each tobacco type. Only then blending of different tobacco types is performed in a separate step in accordance with the respective blending recipe. Blending may occur prior to storage so that the respective blends may be stored in boxes or silos which are opened at the time the blend is further processed, for example in a cigarette making process. Alternatively, blending may be performed at the time the tobacco is further processed, so that the different tobacco types are stored in boxes or silos unblended.

SUMMARY OF SELECTED ASPECTS OF THE DISCLOSURE

The present invention suggests a process for preparing a tobacco blend, in which process at least two different types of tobacco are thermally treated and blended so as to form the tobacco blend, wherein thermally treating as well as blending of the at least two different types of tobacco is performed by the steps of

- providing a combined thermal treating and blending unit comprising an upwardly extending portion,
- introducing a basic process gas into the thermal treating and blending unit to flow through the upwardly extending portion in an upward direction,

- introducing a first type of tobacco into the combined thermal treating and blending unit by means of a first process gas,
- introducing at least a second type of tobacco into the combined thermal treating and blending unit by means of a second process gas, and
- thermally treating and blending of the at least two different types of tobacco within the thermal treating and blending unit.

Throughout the specification, the term "thermally treated", "thermally treating" or "thermal treatment" refers to a process that exposes the tobacco to heat. The thermal treatment is used for example to dry the tobacco, to expand the tobacco or to dry and expand the tobacco.

Accordingly, thermally treating and blending the tobacco is performed in a single process step in a combined thermal treating and blending unit, thereby eliminating the need for a separate blending step. At the same time, the specific treatment of the different types of tobaccos (blend components) can be maintained, as will be described in more detail below. This maintains the advantage of optimizing the specific characteristics of each tobacco type or tobacco blend component, particularly it's flavor. Any pre-blending steps are no longer necessary, for example the pre-blending of Flue Cured and Oriental to form Bright tobacco.

The term "tobacco" as used in connection with the present invention throughout the entire specification is meant to encompass all parts of any tobacco plant, treated or untreated, cut or uncut, that are expandable. It is also meant to include other parts of the tobacco plant, for example stems or pre-treated tobacco, for example flavoured tobacco.

In one variant of the process according to the invention, the at least two different types of tobacco are introduced into the combined thermal treating and blending unit using a process gas having a temperature in the range of about 40 degrees Celsius to about 400 degrees Celsius and a velocity in the range of up to about 100 m/s (meters per second). Depending on the respective type of tobacco the optimal parameters can be selected to optimize the specific characteristics of the respective tobacco type. In a more specific variant of the process according to the invention, the temperature of the process gas is in the range of from about 40 degrees Celsius to about 200 degrees Celsius, and the velocity is in the range of up to about 20 m/s (meters per second).

As the temperature of the process gas in the tower decreases with the height of the tower, the thermal treatment of the tobacco mainly takes place in a lower section of the combined thermal treating and blending unit. With decreasing temperature, the upper section of the combined thermal treating and blending unit serves mainly for blending the tobaccos in the combined thermal treating and blending unit. As the temperature decreases gradually in the combined thermal treating and blending unit, the lower thermal treatment section and the upper blending section may overlap.

Preferably, the moisture content of the blended tobacco in the upper blending section of the combined thermal treating and blending unit is between about 12 percent oven volatiles and about 40 percent oven volatiles, most preferably between about 12 percent oven volatiles and about 25 percent oven volatiles.

Preferably, the gas velocity in the upper blending section is between about 4 m/s and about 100 m/s, preferably between about 4 m/s and about 20 m/s.

Preferably, the temperature in the upper blending section is between about 20 degrees Celsius (i.e., about room temperature) and about 400 degrees Celsius, most preferably between about 20 degrees Celsius and about 200 degrees Celsius.

For example, if the combined thermal treating and blending unit is used only for blending, the parameters in the blending section are preferably about 12 percent oven volatiles moisture content in the tobaccos, the gas velocity is about 6 m/s and the temperature is about 20 degrees Celsius.

In a further variant of the process according to the invention, the combined thermal treating and blending unit comprises an upwardly extending portion with the process gas flowing through the upwardly extending portion in an upward direction.

In still a further variant of the process according to the invention, the different types of tobacco are introduced at different levels of the combined thermal treating and blending unit. Depending on the respective tobacco type, the tobacco can be introduced into the entire flow through the combined thermal treating and blending unit at a level which allows optimal thermal treating and blending of the respective tobacco type. This is particularly true for a thermal treating unit having an upwardly extending portion.

In yet a further variant of the process according to the invention, the process gas and the tobacco blend are separated after thermally treating and blending. For example, this separation can be achieved using a tangential separator or any other type of separator. The thus obtained tobacco blend can then be taken out from the separator and be further processed, for example cooled. Preferably, the fine dust is removed by an axial separator.

The present invention is also directed to an apparatus or assembly for thermally treating and blending a tobacco blend of at least two different types of tobacco comprising an upwardly extending portion having means to introduce a basic process gas into the thermal treating and blending unit to flow through the upwardly extending portion in an upward direction. The apparatus further comprises a first inlet to introduce a first type of tobacco into the combined thermal treating and blending unit by means of a first process gas and at least a second inlet for introducing at least a second type of tobacco into the combined thermal treating and blending unit by means of a second process gas.

Preferably, the apparatus comprises a lower thermal treatment section and an upper blending section.

Preferably, the moisture content of the blended tobacco in the upper blending section of the combined thermal treating and blending unit is between about 12 percent oven volatiles and about 40 percent oven volatiles, most preferably between about 12 percent oven volatiles and about 25 percent oven volatiles.

Preferably, the gas velocity in the upper blending section is between about 4 m/s and about 100 m/s, preferably between about 4 m/s and about 20 m/s.

Preferably, the temperature in the upper blending section is between about 20 degrees Celsius (i.e., about room temperature) and about 400 degrees Celsius, most preferably between about 20 degrees Celsius and about 200 degrees Celsius.

Preferably, the blending section comprises deflector blades that facilitate the blending of the tobacco. Preferably, the deflector blades are fixed to the side walls of the upper blending section. Preferably, the deflector blades are arranged radially.

According to the invention, the inlets may be arranged radially or tangentially (see, e.g., 11, 15, FIG. 4). The inlets may be arranged with a downward slope towards the interior of the thermal treating and blending unit (see, e.g., 12', FIG. 3) without a slope (see e.g., 11, FIG. 3) or with an upward slope (see e.g., 14', FIG. 3). In case the inlet is arranged with a downward slope, the gas velocity may be 0 m/s allowing the tobacco to be introduced into the thermal treating and blending unit through gravity. Two or more inlets may be located at the same vertical level of the thermal treating and blending unit. The two or more inlets located at the same vertical level may be used for the same tobacco blend or blend component, thus advantageously increasing the capacity for the same blend while maintaining the cross section of the inlets.

Alternatively or in addition, the inlets for the different types of tobacco are positioned at different vertical levels of the upwardly extending portion of the combined thermal treating and blending unit.

BRIEF DESCRIPTION OF THE DRAWINGS

Many objects and advantages of the present invention will become apparent to those skilled in the art from this written description taken in conjunction with the appended drawings wherein like reference numerals are applied to like elements and wherein.

DETAILED DESCRIPTION

Figure 1:
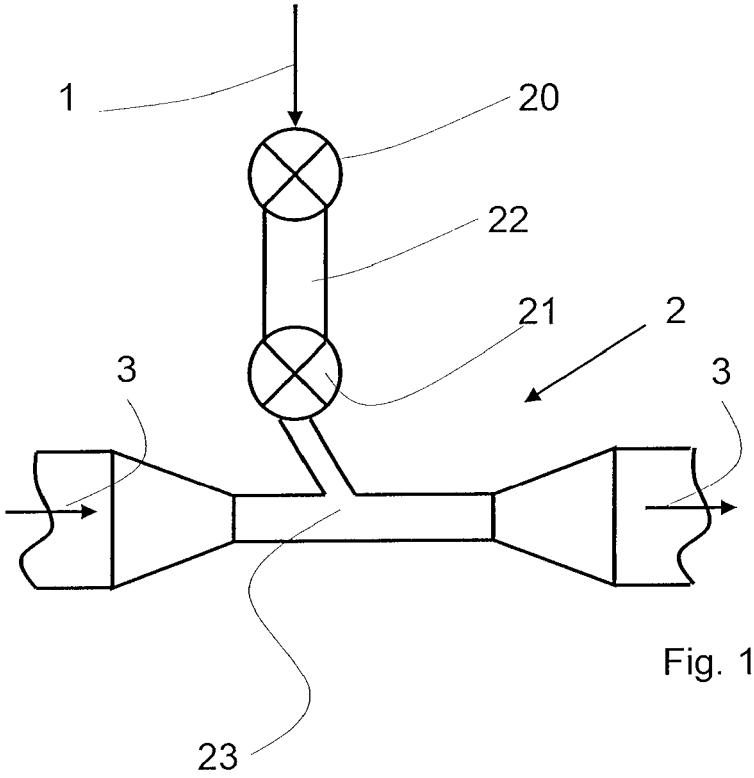
FIG. 1 shows a schematic representation of an embodiment of a supply unit feeding tobacco into a process gas flow flowing through a conduit.

In FIG. 1 an embodiment of a supply unit 1 feeding a specific type of tobacco 1 into a inlet 2 is shown in schematic representation. The tobacco 1 may be any type of tobacco such as mentioned above, and may be pre-treated (for example through moisturizing, impregnation, application of casing, or any other type of conditioning) individually. This allows optimization of the specific characteristics of the respective type of tobacco. While generally each individual type of tobacco 1 may be fed into inlet 2 separately, it is of course possible to pre-blend Flue Cured and Oriental tobacco to form Bright tobacco and to infeed Bright tobacco into inlet 2.

A process gas which is schematically represented in FIG. 1 by arrows 3 flows through inlet 2. Two airlocks 20, 21 are represented or shown, between which a conduit 22 is arranged. The conduit 22 may further comprise a detangling system. By way of example, the detangling system may comprise a two-wheel doffer unit to ensure continuous feeding of tobacco into inlet 2. Inside the conduit 22 an overpressure of about 2 bar relative to the pressure in the upwardly extending portion 40 (see FIG. 2) of thermal treating and blending unit 4 is maintained.

At the location where the tobacco is fed into inlet 2, a venturi 23 is provided for increasing the velocity of the process gas 3. The venturi 23 enhances the feeding or introduction of tobacco into the process gas 3 flowing through inlet 2. The process gas 3 flowing through inlet 2 generally has a velocity which is in the range of up to about 100 m/s (meters per second) and a temperature which is in the range of about 40 degrees Celsius to about 400 degrees Celsius. Depending on the specific type of tobacco the velocity of process gas 3 may be in the range of up to about 20 m/s, and its temperature may be in the range of about 40 degrees Celsius to about 200 degrees Celsius. The process gas typically has low oxygen content and may be, for example, saturated or superheated steam. The tobacco which has been fed into the process gas 3 flowing through inlet 2 may be at least partially expanded within the process gas flowing through inlet 2.

Figure 2:
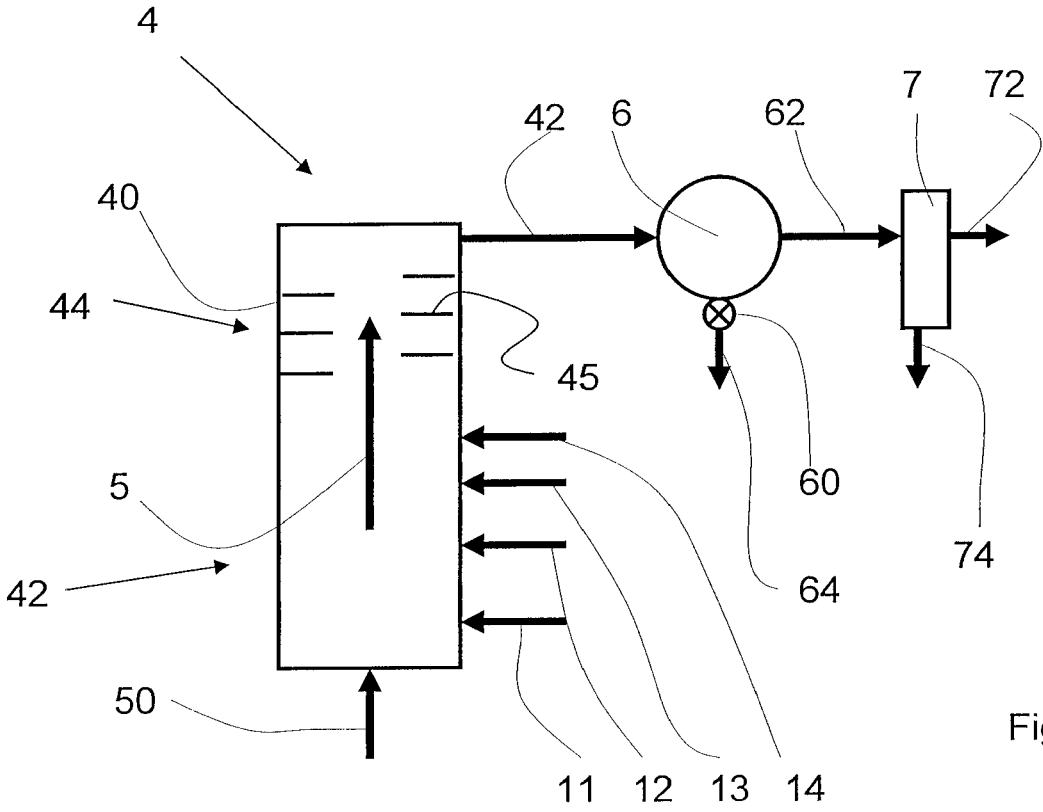
FIG. 2 shows an embodiment of an apparatus comprising a combined thermal treating and blending unit for performing the process according to the invention.
Figure 3:
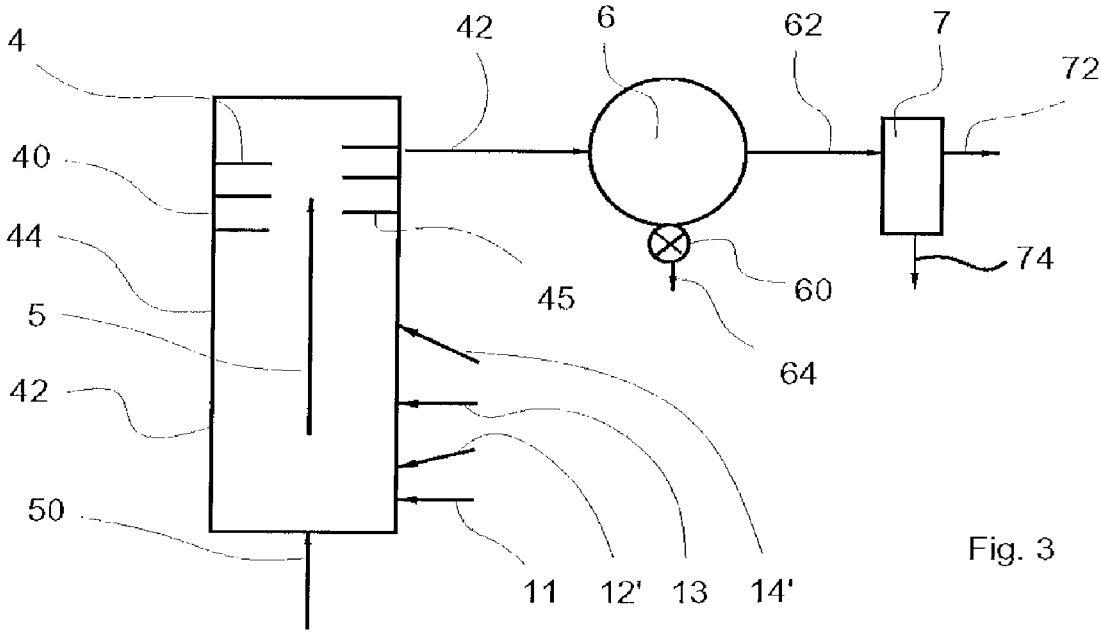
FIG. 3 shows an embodiment similar to FIG. 2 with sloped inlets.
Figure 4:
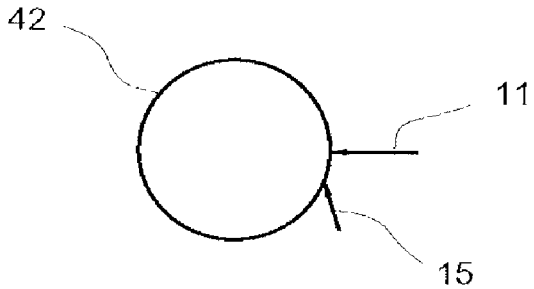
FIG. 4 shows a cross section through the apparatus of FIG. 2 with radial and tangential inlets.

As can be seen in FIG. 2, a number of different inlets 11, 12, 13, 14 may be connected to a combined thermal treating and blending unit 4 such that the process gas 3 carrying the tobacco flows from the respective inlet 11, 12, 13, 14 into the interior of the combined thermal treating and blending unit 4. As can be seen, the thermal treating and blending unit 4 comprises an upwardly extending portion 40. The upwardly extending portion 40 further comprises or includes a lower thermal treatment section 42 and an upper blending section 44. The lower thermal treatment section 42 and the upper blending section 44 may be vertically overlapping. In the upper blending section static deflector blades, elements, or baffles 45 are arranged substantially radially. The deflector blades 45 reduce laminar flow of the process gas, introduce turbulence therein, and thus increase the blending of the tobaccos in the blending section 44.

A process gas 50 is preferably introduced at the bottom of the upwardly extending portion 40 of thermal treating and blending unit 4. The process gas 50 carries the respective types of tobacco in an upward direction 5. The different types of tobacco may be introduced at different levels or vertical positions of the combined thermal treating and blending unit 4.

At the bottom of the upwardly extending portion 40 of the combined thermal treating and blending unit 4, a diffusing system comprising—by way of example—perforated concentrically arranged plates (not shown), may be arranged so as to ensure a homogeneous flow of process gas 50 that enters through this diffusing system. Such process gas 50 may have a velocity of up to about 20 m/s (meters per second) and may have a temperature of up to about 200 degrees Celsius. The process gas 50 may be the same or be different from the process gas 3 passing through the venturi 23.

As can be seen, the inlets 11, 12, 13, 14 are connected to the upwardly extending portion 40 of the combined thermal treating and blending unit 4 at different levels or elevations along the flow of the process gas 50, here at different levels of elevation. Accordingly, the various different tobacco types (blend components) are introduced into the upwardly extending portion 40 of combined thermal treating and blending unit 4 at the respective level depending on the required residence time in the combined thermal treating and blending unit 4 so as to obtain the desired thermal treatment. In the example where the blending of tobacco types Burley, Flue Cured, Oriental, Reconstituted and Stem is envisaged, five separate inlets 11, 12, 13, 14 may be provided and connected to the combined thermal treating and blending unit 4. Reconstituted tobacco and stem are introduced at the top of upwardly extending portion 40. While in FIG. 2 only four discrete inlets 11, 12, 13, 14 are shown by way of example, any other suitable number of inlets 11, 12, 13, 14 may be provided instead. The number of inlets may in particular correspond to the number of different types of tobacco (blend components). Also, depending on the desired blend, not all of the inlets 11, 12, 13, 14 need to be used in the blending.

As the respective type of tobacco has entered the combined thermal treating and blending unit 4 together with the process gas 3 through the respective inlet 2, it is thermally treated within unit 4 and blended with those types of tobacco which have already entered the interior of combined thermal treating and blending unit 4 at a lower level. Once the tobacco introduced through the uppermost inlet 14 has entered the interior of the combined thermal treating and blending unit 4, the thermally treating and blending of all different tobacco types introduced is performed. After this thermally treating and blending process, the final blend is carried along with the flow of process gas 5 through a first conduit 42 into a separator 6. The separator 6, by way of example, may be embodied as a tangential separator. Within the separator 6, the tobacco blend is separated from the process gas 5 and collected at the bottom of the tangential separator 6. Such separators 6 are well-known in the art.

At the bottom of the tangential separator 6 a further airlock 60 may be provided, through which the tobacco can be discharged from the separator 6. It is preferred that the temperature of the tobacco blend not exceed about 100 degrees Celsius, and even more preferred not exceed about 60 degrees Celsius, so as to avoid any off-taste impact. Preferably the moisture is about 12%. The tobacco blend is discharged through the airlock 60 to be further processed. For example the tobacco blend may be discharged onto a hooded vibrating conveyor to remove the fumes or to reject any undesired components contained in the blend using spark detection or both. The tobacco blend is then cooled using a closed loop air system, preferably a cooling conveyor (not shown).

The process gas separated from the tobacco by means of the tangential separator 6 flows through a second conduit 62 into an axial dust cyclone 7 for fine dust separation. At the bottom of the axial dust cyclone 7 the fine dust is collected and discharged through outlet 74. The thus purged process gas can then be forwarded through a third conduit 72 to a furnace (not shown) where it is heated again, returned and used again as process gas 3, 50 carrying tobacco through the inlet 2.

In this specification, the word "about" is sometimes used in connection with numerical values to obviate any reliance on absolute mathematical precision. Consistent with that intent, the word "about" when used with a numerical value should be interpreted to include a tolerance of about ±5% around the nominal value.

This written description, and its various parts and sections, are intended to be exemplary and not limiting. Thus, neither the abstract nor the summary should be used to restrictively interpret the scope of the invention; rather the entire written description, the appended drawings, and the features described and depicted therein should be interpreted with the breadth to which each is fairly entitled under the law.

It will now be apparent to those skilled in the art that the foregoing description and the appended drawings describe novel and nonobvious processes and apparatus. Moreover, it will be apparent to those skilled in the art that various modifications, variations, substitutions, and equivalents exist for features of the invention that do not materially depart from the spirit and scope of the invention. Accordingly, it is expressly intended that all such modifications, variations, substitutions, and equivalents for features of the invention that do not materially depart from the spirit and scope of the invention as set forth in the appended claims be embraced thereby.

What is claimed is:

1. A process for preparing a tobacco blend, in which process at least two different types of tobacco are thermally treated and blended so as to form the tobacco blend, wherein thermally treating as well as blending of the at least two different types of tobacco is performed in a combined thermal treating and blending unit having an upwardly extending portion by the steps of:

introducing a basic process gas into the thermal treating and blending unit to flow through the upwardly extending portion in an upward direction;

introducing a first type of tobacco into the combined thermal treating and blending unit by flowing a first process gas through a first conduit at a velocity sufficient to carry the first type of tobacco;

introducing at least a second type of tobacco into the combined thermal treating and blending unit by flowing a second process gas through a second conduit at a velocity sufficient to carry the second type of tobacco;

thermally treating and blending the at least two different types of tobacco within the thermal treating and blending unit by carrying the first type of tobacco and the second type of tobacco upwardly through the thermal treating and blending unit via the basic process gas to form a tobacco blend; and reducing laminar flow of the basic process gas to increase the blending of the first type of tobacco and the second type of tobacco within the thermal treating and blending unit by rotating deflector blades therein.

2. The process according to claim 1, wherein any of the process gases has a temperature in the range of about 40 degrees Celsius to about 400 degrees Celsius and a velocity in the range of up to about 100 m/s.

3. The process according to claim 2, wherein the temperature of the process gas is in the range of from about 40 degrees Celsius to 200 degrees Celsius, and wherein the velocity is in the range of up to about 20 m/s.

4. The process according to claim 1, wherein the different types of tobacco are introduced at different vertical levels of the upwardly extending portion of the combined thermal treating and blending unit.

5. The process of claim 1, further including the step of separating the tobacco blend from the process gas.

6. The process of claim 1, wherein the different types of tobacco are introduced at different vertical levels of the upwardly extending portion of the combined thermal treating and blending unit and wherein three or more different types of tobacco are introduced.

7. The process of claim 1, wherein the different types of tobacco are introduced at different vertical levels of the upwardly extending portion of the combined thermal treating and blending unit and wherein reconstituted tobacco is introduced through an uppermost inlet.

8. The process of claim 1, further including the step of separating the tobacco blend from the process gas, wherein the separated tobacco has a temperature below about 60° C. and a moisture content of about 12%.

9. The process of claim 1, further including separating the blended tobacco from the process gas, heating the process gas and recycling the heated process gas to the thermal treating and blending unit.

* * * * *